US005851100A

United States Patent [19]

Brandt

[11] Patent Number: 5,851,100

[45] Date of Patent: Dec. 22, 1998

[54] AUTO CYCLE SWIVEL MOUNTED CONTAINER HANDLING SYSTEM

[75] Inventor: Calvin J. Brandt, Delano, Minn.

[73] Assignee: McNeilus Truck and Manufacturing, Inc., Dodge Center, Minn.

[21] Appl. No.: 843,024

[22] Filed: Apr. 11, 1997

[51] Int. Cl.[6] ..... B65F 3/04

[52] U.S. Cl. ..... 414/408; 414/421; 414/550; 414/555; 414/730; 414/810; 414/812

[58] Field of Search ..... 414/408, 419, 414/421, 486, 487, 555, 546, 729, 730, 650, 550, 810, 812; 901/9, 28

[56] References Cited

U.S. PATENT DOCUMENTS

| | | | |
|---|---|---|---|
| 4,119,212 | 10/1978 | Flemming | 414/730 X |
| 4,175,903 | 11/1979 | Carson | 414/408 |
| 5,019,761 | 5/1991 | Kraft | 414/730 X |
| 5,215,423 | 6/1993 | Schulte-Hinsken et al. | 414/408 |
| 5,222,853 | 6/1993 | Carson | 414/408 |
| 5,330,308 | 7/1994 | Armando et al. | 414/408 |
| 5,391,039 | 2/1995 | Holtom | 414/408 |
| 5,505,576 | 4/1996 | Sizemore et al. | 414/408 X |
| 5,525,022 | 6/1996 | Huntoon | 414/408 X |
| 5,720,589 | 2/1998 | Christenson et al. | 414/408 |

*Primary Examiner*—David A. Bucci
*Attorney, Agent, or Firm*—Haugen and Nikolai, P.A.

[57] ABSTRACT

A refuse and/or collection vehicle having an automated container handling mechanism that may automatically lift and dump a container into a charging hopper of the vehicle. A microprocessor controls the extension and lift of the container handling mechanism and analyzes the output voltage of potentiometers coupled to the container handling mechanism to thereby coordinate actuation of the container handling mechanism and smoothly pick up the container from the curbside, dump the container in the charging hopper, and return the container to the same position on the curbside but above the ground a predetermined distance.

15 Claims, 10 Drawing Sheets

AUTO CYCLE SWIVEL MOUNTED CONTAINER HANDLING SYSTEM

BACKGROUND OF THE INVENTION

I. Field of the Invention

This invention relates generally to lift and dump mechanisms for lifting and emptying containers, particularly refuse containers, into refuse vehicles. More particularly, this invention relates to a device and method that automatically lifts, dumps and returns a container to the same location on the curbside. Position sensitive potentiometers coupled to the container handling mechanism generate signals that allow coordination of the various members of the container handling mechanism for smooth operation and automatic return of the container handling mechanism to an initial position.

II. Discussion of the Related Art

Over the years, various devices have been used to transfer the contents of waste receptacles into the storage bodies of refuse vehicles. Refuse vehicles may load from the front, side or rear. Mechanized material handling devices often include a container holder or grasping device connected to an arm which is connected to a base, such as a vehicle. The arm and grasping device are operated to engage a container of interest, lift and dump the container into a receiving hopper in the vehicle.

A representative example of such a device appears in U.S. Pat. No. 5,391,039, issued to Holtom, which describes a refuse loader arm including a lift limb and a reach limb articulated to one another at a pivot point. The lift limb is vertically pivotally attached at one end to a refuse vehicle and the reach limb is articulated at its other end to a bin grasping assembly which is held at a constant angle to the lift limb by a parallelogram linkage. The lift limb and the reach limb pivot in a common plane to reach out and grasp the container of interest and lift and dump the container. Of course, the vehicle must be positioned directly alongside the container such that the container is aligned with the pivoting plane of the arm. U.S. Pat. No. 5,330,308, issued to Armando et al., describes a refuse container loading device including a tubular support attached to a refuse vehicle, operable to pivot in a horizontal plane. A telescoping arm that pivots vertically is attached to the base and to a bin grasping device that is able to pivot vertically and swivel horizontally.

Similarly, U.S. Pat. No. 4,175,903, issued to Carson, describes an apparatus for picking up containers wherein a boom arm is attached to a platform which is pivotally attached to a refuse vehicle for rotating in a generally horizontal plane. The boom arm is pivotally attached to the platform for pivoting vertically to raise and dump a container. A pick-up arm is provided to grasp the container and is attached to the boom arm with the ability to rotate in essentially a horizontal plane. The devices described in the '308 and '903 patents eliminate the need for precise positioning of the vehicle, but the lift and dump arms are quite complex.

In its simplest form, a fluid-operated actuator system includes a single linear actuator linked to operate on a single machine part. This actuator supplies the force needed to move the part. A jointed arm, for example, usually requires several actuators or a single actuator connected to operate a complex linkage in order to smoothly operate the jointed arm. The jointed arm may be designed using a plurality of actuators coupled in series, the actuation of which must be coordinated in order for the mechanized system to work smoothly. Otherwise, the device may not work as desired, for example, it may jam and even cause severe damage to the mechanical components and other parts of the machine. In this regard a need presently exists for a device and method to improve coordination of such a system. The present invention contemplates coordination of the actuation of fluid operated double acting cylinders coupled in series to a relatively simple lift and dump arm in a manner that avoids jamming and mechanical damage.

The operation of the conventional lift arms and grasping devices often requires that the operator joggle or shake the container while in the dump position to remove any contents jammed in the container. The operator must then manually control the positioning of the arm and grasping device in order to place the container on the ground. During this manual operation, it may be difficult for the operator to return to container to the exact position from which it was removed. Replacing a container between other objects in close proximity may prove difficult without incidental contact with the other objects or slamming of the container into the ground. Therefore, there is a need for a device and method to automatically and smoothly return a container to its original position after dumping. The present invention also addresses these and other needs.

SUMMARY OF THE INVENTION

The purpose of the present invention is to provide a refuse and/or collection vehicle having a lift and dump mechanism that may automatically lift, dump and return a container of interest to the curbside. The vehicle includes a frame and container handling mechanism attached to the frame. The container handling mechanism generally includes an articulated arm having an actuated reach arm, lift arm and articulated grabber. The reach arm and the lift arm both have a fixed end and a free end. The fixed end of the reach arm is pivotally attached to an actuated swivel mount to allow fore and aft positioning of the grabber relative to the frame of the refuse vehicle. The free end of the reach arm is attached to the fixed end of lift. The free end of the lift arm is attached to the articulated grabber.

A plurality of potentiometers are mechanically coupled to the reach arm, lift arm and swivel mount and are electrically coupled to an analog circuit. The analog circuit is electrically coupled to a programmable microprocessor based controller interface. Each potentiometer transmits an output voltage to the analog circuit which stores these values. The output voltages of the potentiometers are representative of the position of the reach arm, lift arm, and swivel mount with respect to the frame and hence each other. The analog circuit uses the output voltages transmitted by the potentiometers to transmit corresponding data to the programmable controller interface.

The microprocessor based controller includes software to process data from the analog circuit and provide output signals to control the activation of actuators attached to the reach arm, lift arm, and swivel mount, thereby coordinating the actuation of double acting cylinders attached to the reach arm, lift arm and swivel mount. The controller is coupled to pneumatic and hydraulic circuits which control corresponding hydraulic double acting cylinders for lifting and extending the arms and for controlling the swivelling of the swivel mount. In this manner, a container of interest may be automatically lifted and dumped above the charging hopper and returned to the same curbside position at a level slightly above the ground to avoid slamming the container into the ground.

OBJECTS

It is accordingly a principal object of the present invention to provide a device for automatically controlling the lift and dump cycle of a container handling mechanism.

Another object of the present invention is to provide a device and method for automatically lifting a container from the curbside, dumping the container into a charging hopper, and returning the container to the same position on the curbside.

A further object of the present invention is to provide a device and method that allows the user to manually or automatically lift and dump a container of interest with the container handling mechanism.

These and other objects, as well as these and other features and advantages of the present invention will become readily apparent to those skilled in the art from a review of the following detailed description of the preferred embodiment in conjunction with the accompanying drawings and claims and in which like numerals in the several views refer to corresponding parts.

DETAILED DESCRIPTION

Figure 1:
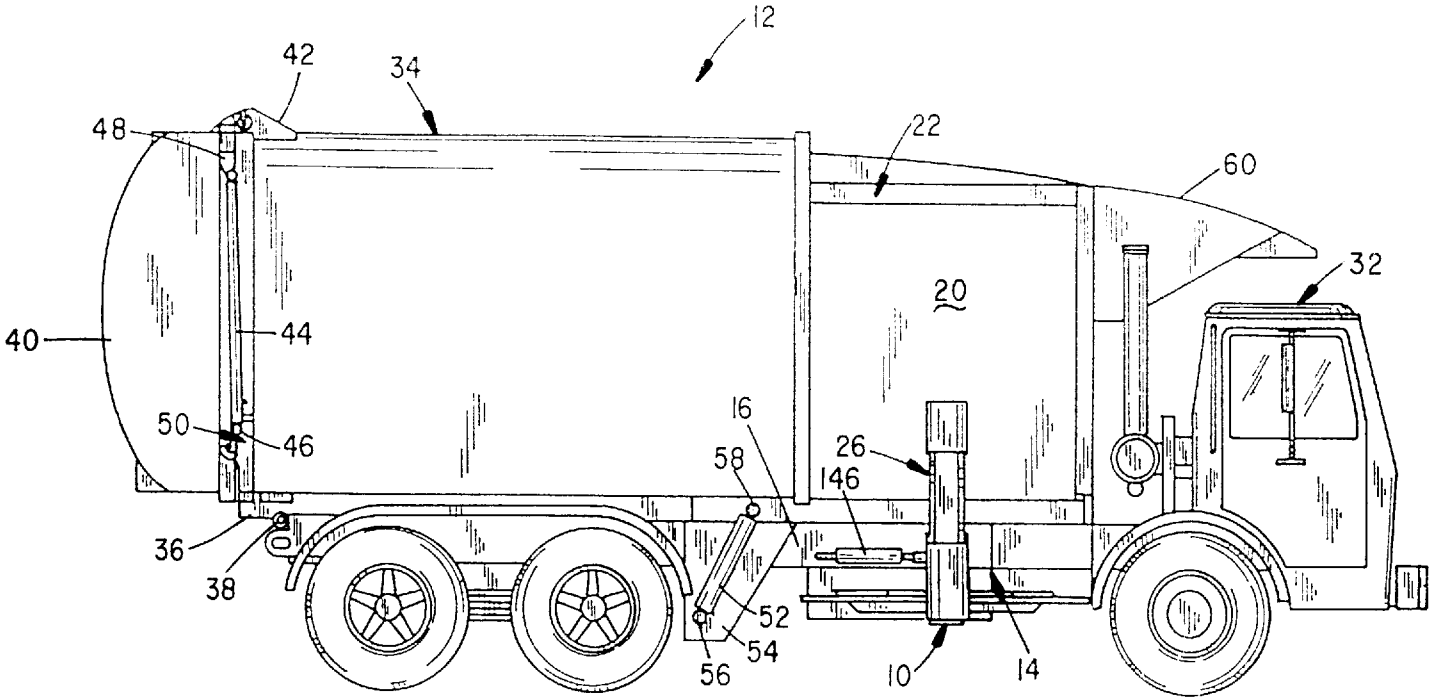
FIG. 1 is a side elevational view of a refuse collection vehicle suitable for use with a container handling system having a lift arm and extension arm.

The present invention represents broadly applicable improvements in a class of loading devices which can take form in any of a variety of embodiments. The embodiments detailed herein are intended to be taken as representative or exemplary of those in which the improvements of the invention may be incorporated and are not presented as being limiting in any manner.

In the drawings of this application, unless specifically designated, only even numbered reference numerals have been employed. Thus, within any designated sequence span, only even numbers are intended.

Figure 2:
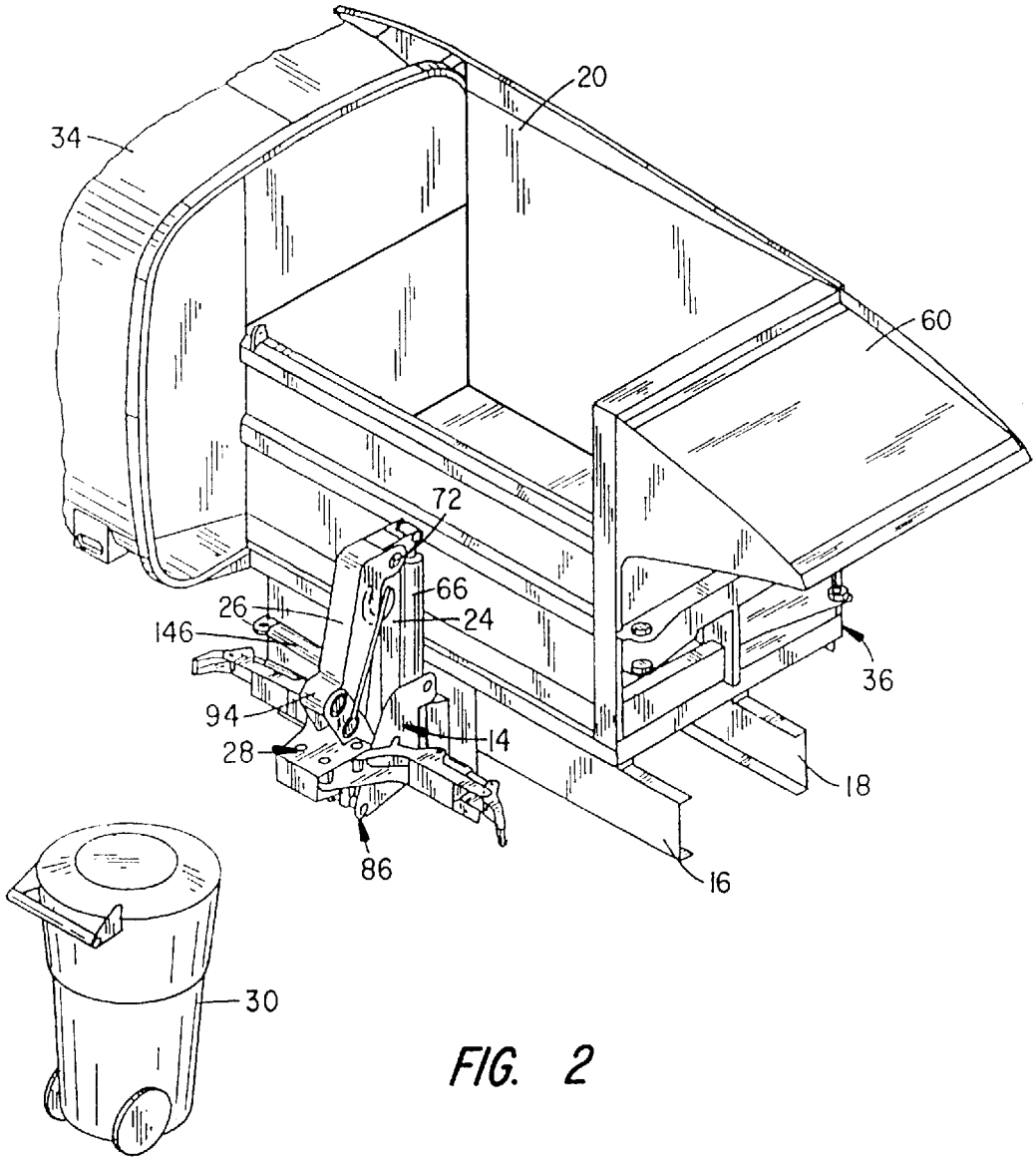
FIG. 2 is a fragmentary perspective view from the embodiment of FIG. 1, showing the container handling system in the stowed position.

Referring first to FIGS. 1 and 2, the container handling mechanism 10 of the present invention is shown mounted to a side loading refuse vehicle 12. The handling mechanism 10 includes a swivel mount, generally at 14, which is attached to one of two spaced main frame or chassis members 16–18 (see FIG. 2) of the refuse vehicle 12. The swivel mount 14 is attached to the frame member 16 underneath a refuse receiving or charging hopper 20, which includes a top opening as at 22, for receiving refuse. Details of the swivel mount 14 will be described below in greater detail. A hinged or pivoting lift arm, generally at 26, has a fixed end pivotally connected to the swivel mount 14 and a free end pivotally connected to a refuse container holder or grabber, generally at 28. As will be described below, the swivel mount 14 enables the position of the extension arm 24, lift arm 26 and container holder 28 to be adjusted back and forth along the length of the refuse vehicle 12 to accommodate a container 30 of interest in a variety of locations. The grabber 28, extension arm 24, and lift arm 26 cooperate to empty refuse containers into the charging hopper 20 through opening 22.

The refuse vehicle 12 includes a cab 32 and a storage body 34 connected to receive material from charging hopper 20 carried on a common sub-frame 36 which, in turn, may be pivotally attached to heavy chassis frame members 16–18 as at 38. The charging hopper 20 is aligned with the storage body 34 for compacting refuse into the storage body 34. The storage body 34 includes a tailgate 40 which is pivotally carried by a pair of hinges, one of which appears at 42, mounted at the top of the storage body 34. The tailgate 42 is operated between an open and a closed position by a pair of hydraulic cylinders, one of which is shown at 44, which are pivotally attached to the tailgate 40, as at 46, and to the storage body 34, as at 48. Side latches, as at 50, are provided for latching tailgate 40 to the storage body 34 in a well-known manner. The tailgate 40 is designed to open in conjunction with the tilting of the storage body 34 to discharge refuse. Tilting is accomplished by a pair of spaced side mounted hydraulic lift cylinders, one of which appears at 52, that are pivotally attached between the frame by a heavy lug or gusset member 54 at 56 and to the storage body 34 sub-frame 36 at 58. A cab protector is shown at 60 and the entire system is supported by a plurality of wheels.

Figure 3:
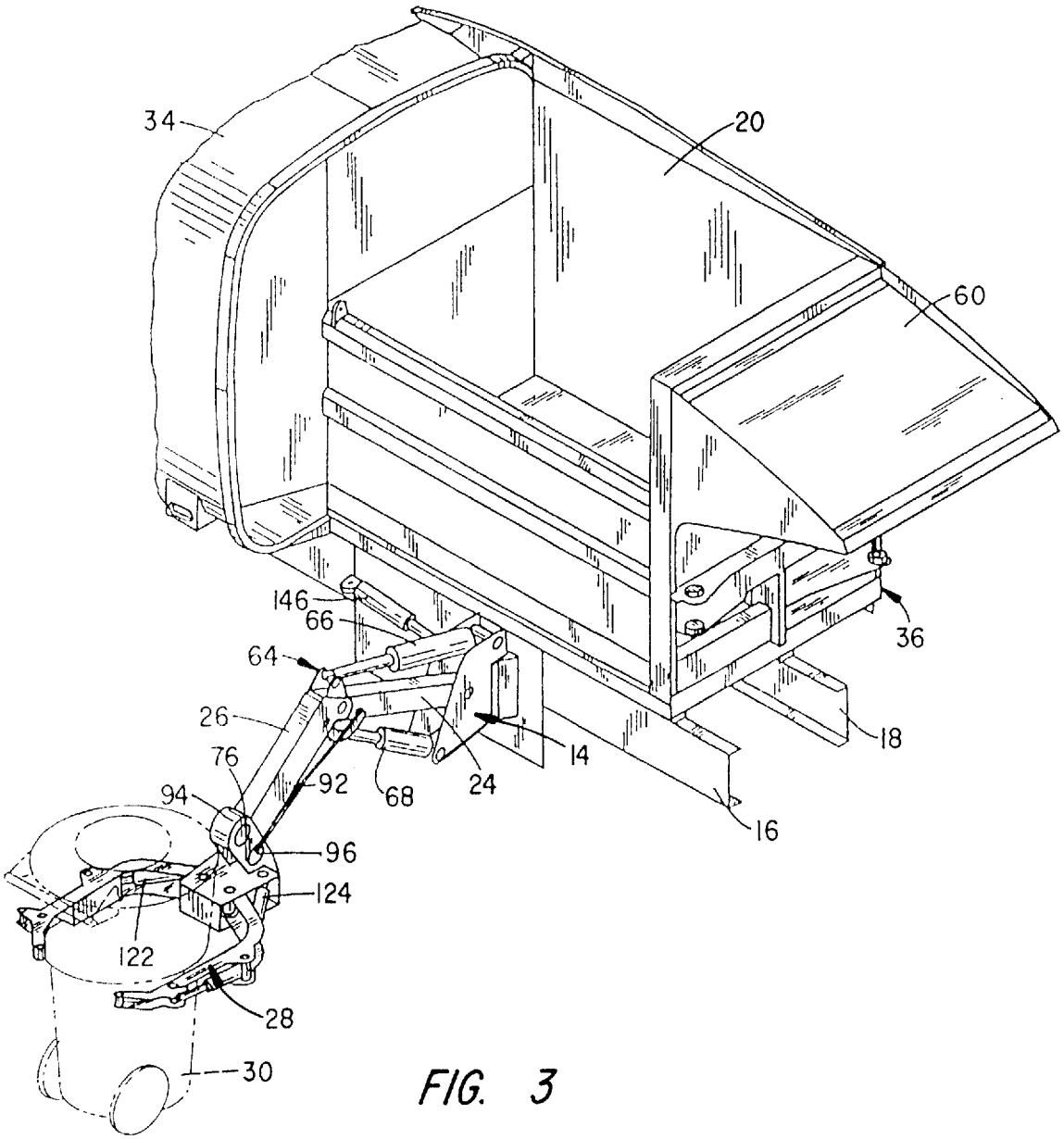
FIG. 3 is a fragmentary perspective view similar to that of FIG. 2 showing a container (in phantom) as having been seized by the container handling system.
Figure 4:
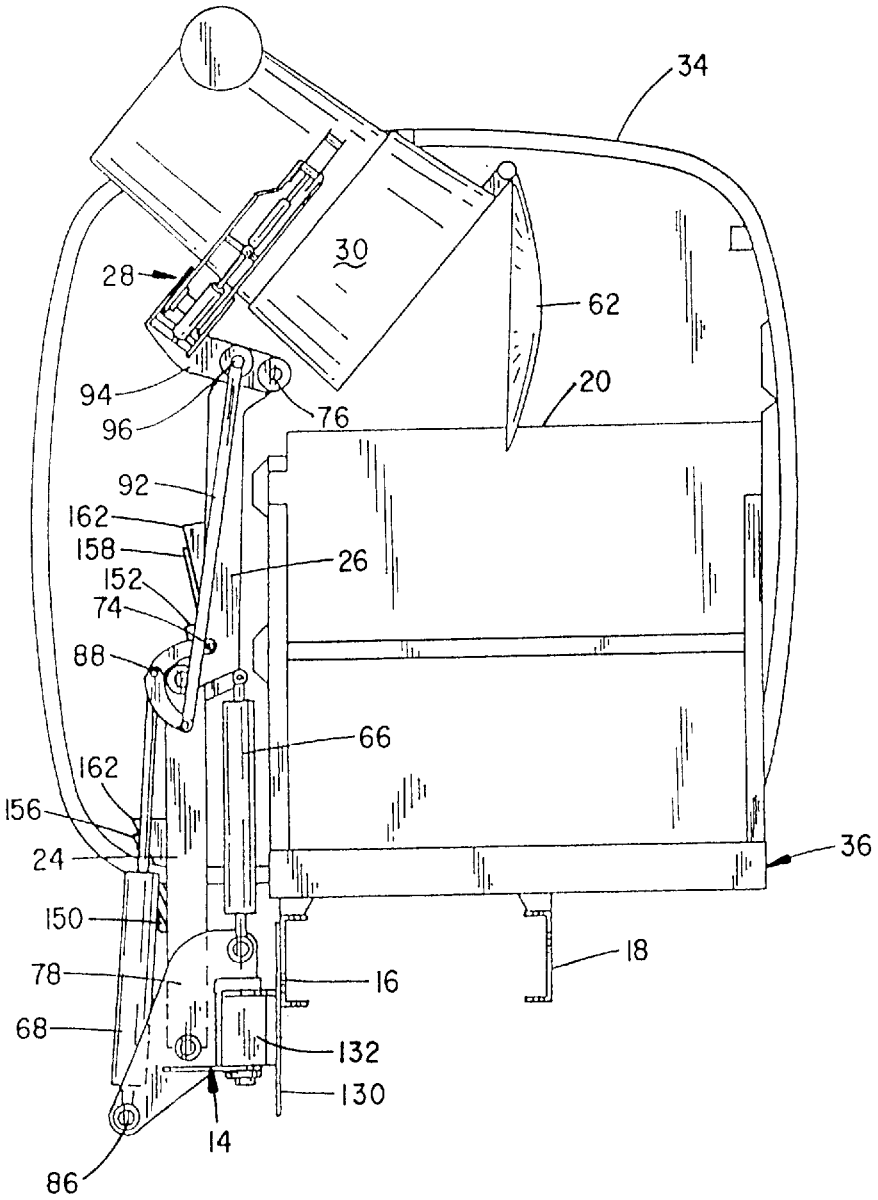
FIG. 4 is a fragmentary perspective view similar to that of FIG. 3 illustrating both the seized container in the raised, inverted or tipped position and the relative alignment of potentiometers associated with the lift arm and extension arm.

FIGS. 2–4 shows the position of the container handling mechanism 10 and associated extension 24 and lift 26 arms during a dump cycle. As will be described in greater detail below, the extendable arm 24 and swivel mount 14 combination enables the position of the lift arm 26 and container holder 28 to be adjusted laterally and back and forth along the length of the refuse vehicle 12 to accommodate handling a container of interest anywhere within a relatively extensive range. The grabber system 28, lift arm 26 and extension arm 24 cooperate to approach, seize, lift, empty, and return the refuse containers. FIG. 2 shows the container handling mechanism in a stowed position and aligned with a container 30 and with the grabber fully opened to minimize lateral protrusion with respect to the vehicle. FIG. 3 shows the container handling mechanism 10 extended and grabbing a container 30 of interest. FIG. 4 shows the container handling mechanism 10 in a dump position with the lid 62 of container 30 pivoted open. Those skilled in the art will appreciate that curbside refuse containers 30 need not be aligned at a particular spot or be particularly close to the truck 12 so long as they are in the range of the extendable arm 24. Once the container is seized by grabber 28, the operator may initiate an automatic dump cycle which lifts, empties and returns the container near its original position above the ground a predetermined amount. The details of the auto dump cycle will be described below in greater detail in conjunction with the description of FIGS. 7–10.

Figure 5:
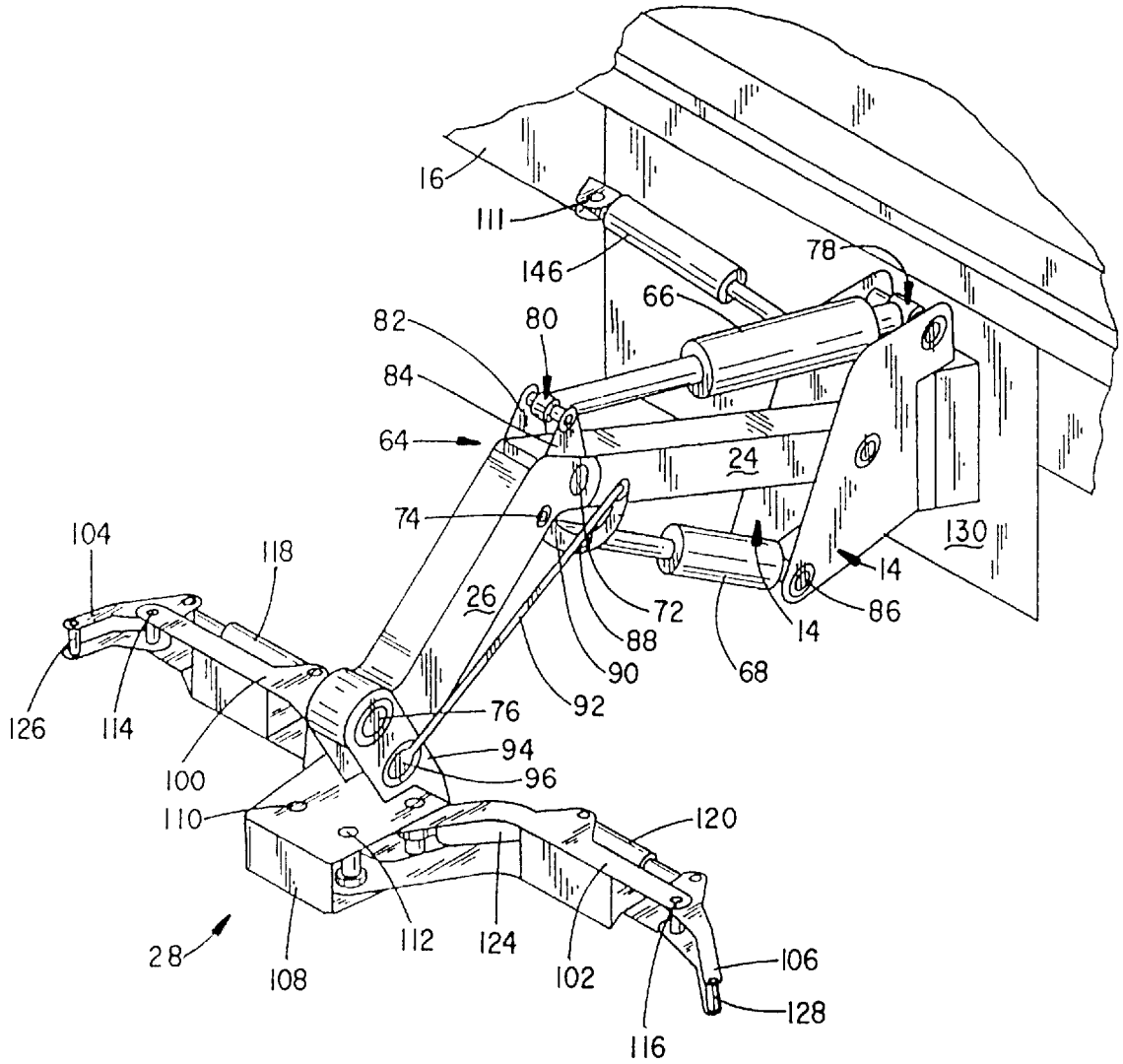
FIG. 5 is an enlarged fragmentary perspective view illustrating details of the container handling mechanism.

FIG. 5 shows in greater detail the preferred embodiment of the container handling mechanism 10, depicting the articulated extendable lift-and-dump arms 24–26 of the invention in greater detail. The extension arm 24 and lift arm 26 are pivotally connected at a central joint 64. Extension arm 24 is pivotally attached between the swivel mount 14 as at 70 and central joint 64 as at 72. Lift arm 26 is pivotally attached between central joint 64 as at 74 and grabber system 28 as at 76. The joints of the system, particularly those of the articulated extension and lift arms 24–26, may be provided with conventional resilient bushings to cushion the operation of the system and increase the life of the mechanical joints. These may be of a rubber compound or other durable resilient material of a durometer to reduce shock yet not affect mechanical joint performance. Alternatively, the pivot joints may be maintenance free greaseless connections as shown in co-pending U.S. patent application Ser. No. 08/752,220 filed Nov. 19, 1996 and assigned the he same assignees as the present invention, the entire disclosure of which is incorporated herein by reference.

The extension arm 24 and lift arm 26 are operated by a pair of linear actuators, preferably double acting hydraulic cylinders. The extension arm 24 has an upper or reach controlling cylinder 66 and the lift arm 26 has a lift, lift/tipping, or dumping cylinder 68, each being mounted with a rod end and a pivotally connected cylinder end. The cylinder end of reach cylinder 66 is pivotally connected to wrist pin pivot joint 78 and the rod end is pivotally connected to a second wrist pin type pivot joint 80 connected between spaced lugs 82 and 84 fixed at central joint 64. The cylinder end of the lift cylinder or actuator 68 is connected pivotally at joint 86 and the rod end is pivotally connected to a common pin member 88. The pin member 88 joins the common joint of spaced pairs of arcuate linkage elements 90 and associated linking rods as at 92. A grabber mounting and pivot segment 94 pivotally connects the grabber system 28 to the lift arm 26 as at 76. The pair of spaced operating following rods or linkage bars, one of which is shown at 92, are attached to pivot segment 94. These rods flank the lift arm 26, and pivot the grabber 28 for dumping as the lift cylinder 68 is extended.

The grabber 28 includes opposed digits or compound jaw elements having inner segments 100 and 102 flanked by outer segments 104 and 106. The inner segments 100 and 102 are pivotally connected to a base element 108 at 110 and 112, respectively, and outer segments 104 and 106 likewise are pivotally connected to the respective inner elements at 114 and 116. The opposed segments are operated to close or open to seize or release a rigid container 30 by pivotally connected, oppositely disposed pairs of linear actuators, including inner and outer actuators 118 and 120 operating outer segments 104 and 106, respectively, and inner and outer actuators 122 and 124 (see also FIG. 3), in a like and symmetric manner, operating inner segments 100 and 102. Roller members 126 and 128 mounted in the outer segments 104 and 106 guide the outer segments in following the periphery of a container of interest to be seized. Each roller member 126–128 may be made from a rubber material or plastic material such as high density polyethylene. Details of additional suitable grasping or grabber devices may be had by consulting U.S. patent application Ser. No. 08/342,752, entitled CONTAINER HOLDING AND LIFTING DEVICE, filed Nov. 21, 1994 now abandoned and U.S. patent application Ser. No. 08/716,999, entitled CONTAINER GRABBING DEVICE, filed Sep. 20, 1996, now U.S. Pat. No. 5,769,592, issued Jun. 23, 1998, both of which have been assigned to the same assignee as the present application, the disclosures of which are hereby incorporated by referenced herein for any necessary purpose.

Figure 6:
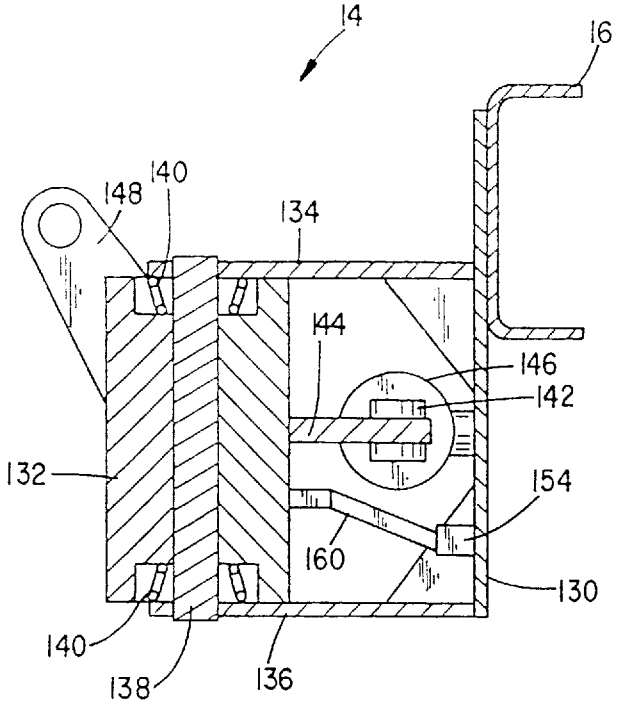
FIG. 6 is a partial sectional enlarged side elevational view of one type of hydraulically operated swivel mount and a potentiometer attached thereto.

FIG. 6 shows a portion of the swivel mount 14, the details of which will next be presented. The swivel mount 14 includes heavy base plate 130 affixed to frame member 16 underneath the side of recessed or offset refuse receiving or charging hopper 20. A base pivot member 132 is aligned between upper and lower flanges 134 and 136 through which a pivot shaft 138 is journaled for rotation on spaced bearings 140. An operable swivel arm 142 and connecting link 144 are keyed to the pivot member or shaft 132. The rod end of a base pivot cylinder 146 is connected to the swivel arm 142. The extension arm 24 is pivotally mounted to a dual plate mounted to flanges 134–136 (see FIG. 4). The extension or reach cylinder 66 mounts to member 148 extending from the pivot member 132 between the dual plates. Extension and retraction of the base pivot cylinder 146 rotates or swivels the pivot member 132, thereby pivoting the dual plate and extension arm 24 forward and aft in relationship to the vehicle chassis. The fluid lines to cylinders 66–68, 118–124 and swivel cylinder 146 are coupled to means for controlling the cylinders, as discussed below in further detail.

The control system of the present invention employs potentiometric devices to determine the relative position of certain parts. Referring to FIGS. 4 and 6, potentiometers 150–154 of known suitable construction are shown coupled to the respective extension arm 24, lift arm 26 and swivel mount 14. Each potentiometer includes a shaft that rotates within the potentiometer as the position of the corresponding extension arm 24, lift arm 26, or swivel mount 14 changes. As the shaft rotates the resistance within the potentiometer changes, thereby changing an output voltage relative to an input voltage. The amount of the measured output voltage is used to correlate the position of the shaft with the position of the corresponding extension arm 24, lift arm 26, or swivel mount 14. As shown in the drawings, bars 156–160 are attached to the shaft of the respective potentiometers 150–154. Bars 156–158 travel in a groove formed in ramp 162 attached to respectively to the extension arm 24 and lift arm 26. A spring (not shown) applies a constant pressures against the bar, thereby engaging the bar against ramp 162. As the bar moves up and down the ramp, the shaft of the potentiometer rotates, changing the measured output voltage of the potentiometer. The ramp 160 tends to accentuate the rotation of the shaft as the corresponding cylinders of the extension arm 24 and lift arm 26 are extended and retracted. Potentiometer 154 has a jointed bar 160 attached to the shaft thereto. The free end of the jointed bar is fixed to pivot member 132. As the pivot member 132 rotates, the bar 160 in turn rotates the shaft of potentiometer 154. The bar is jointed to allow movement through approximately 180° . A potentiometer of suitable known construction is available from Duncan, Inc., part number 9810-661-2 RE 56155 96-07 having a resistance between 0–5 k ohms.

Figure 7:
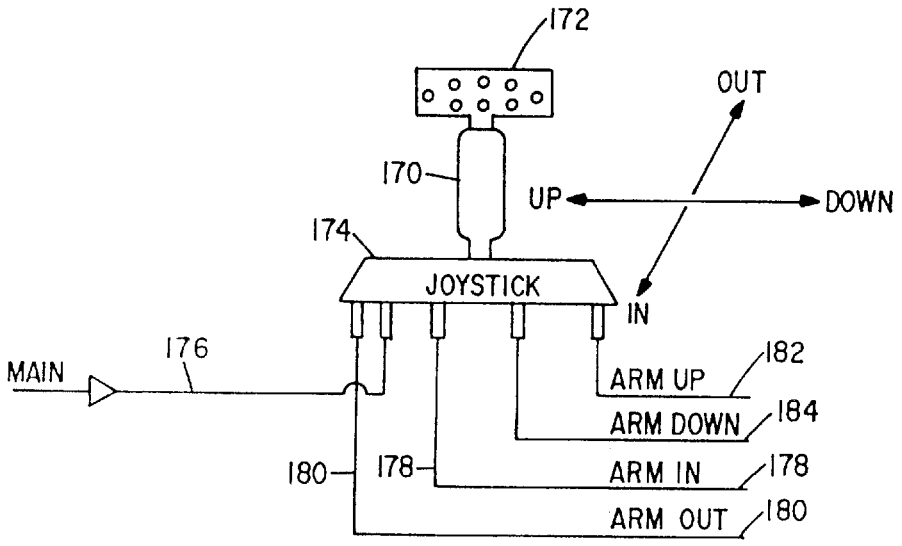
FIG. 7 is a fragmented side elevational schematic view of the joystick and pad, showing the associated pneumatic lines extending from the joystick.
Figure 8:
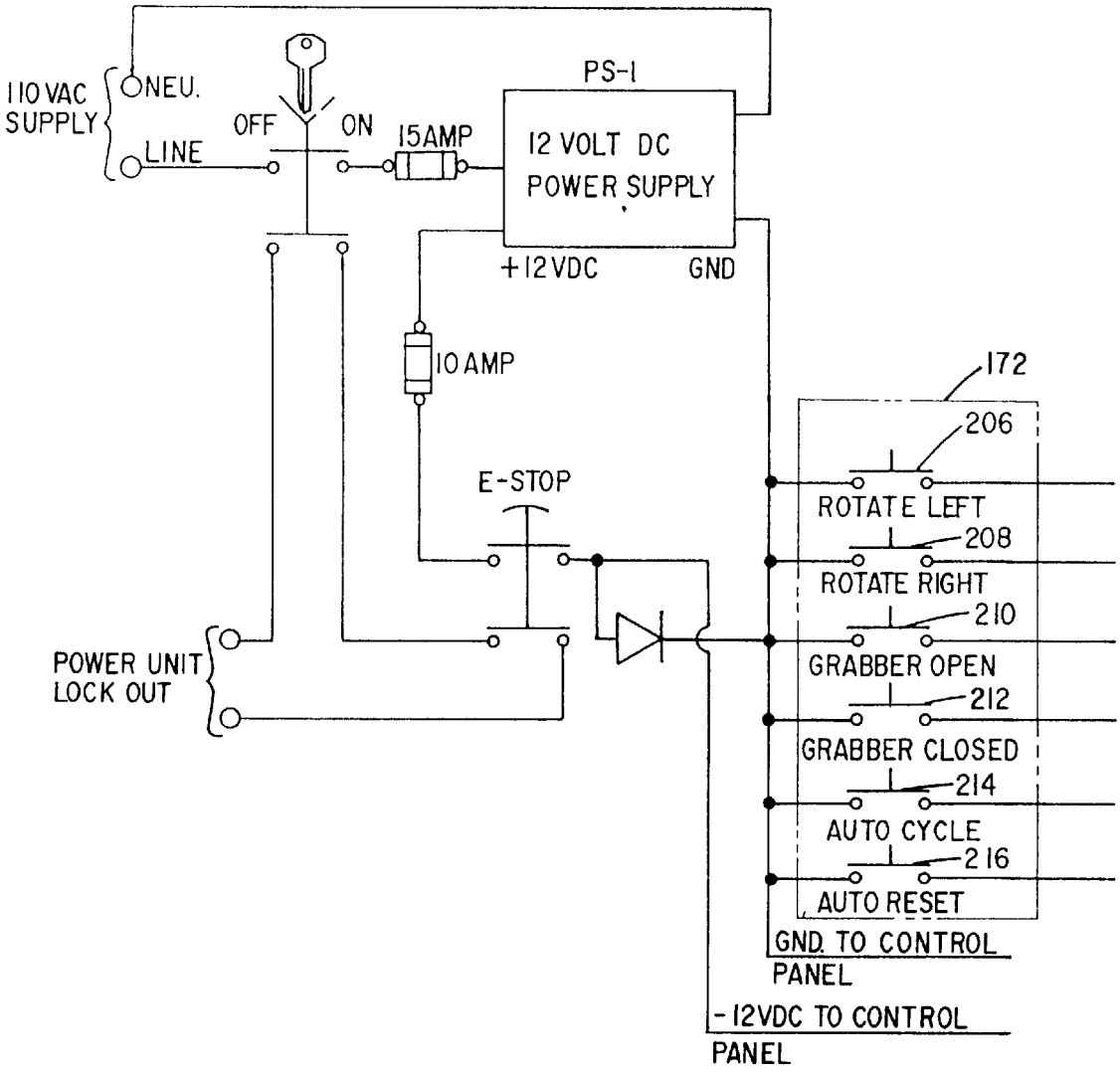
FIG. 8 is a partial schematic diagram of an electric circuit electrically coupled to the pad shown in FIG. 7.
Figure 9:
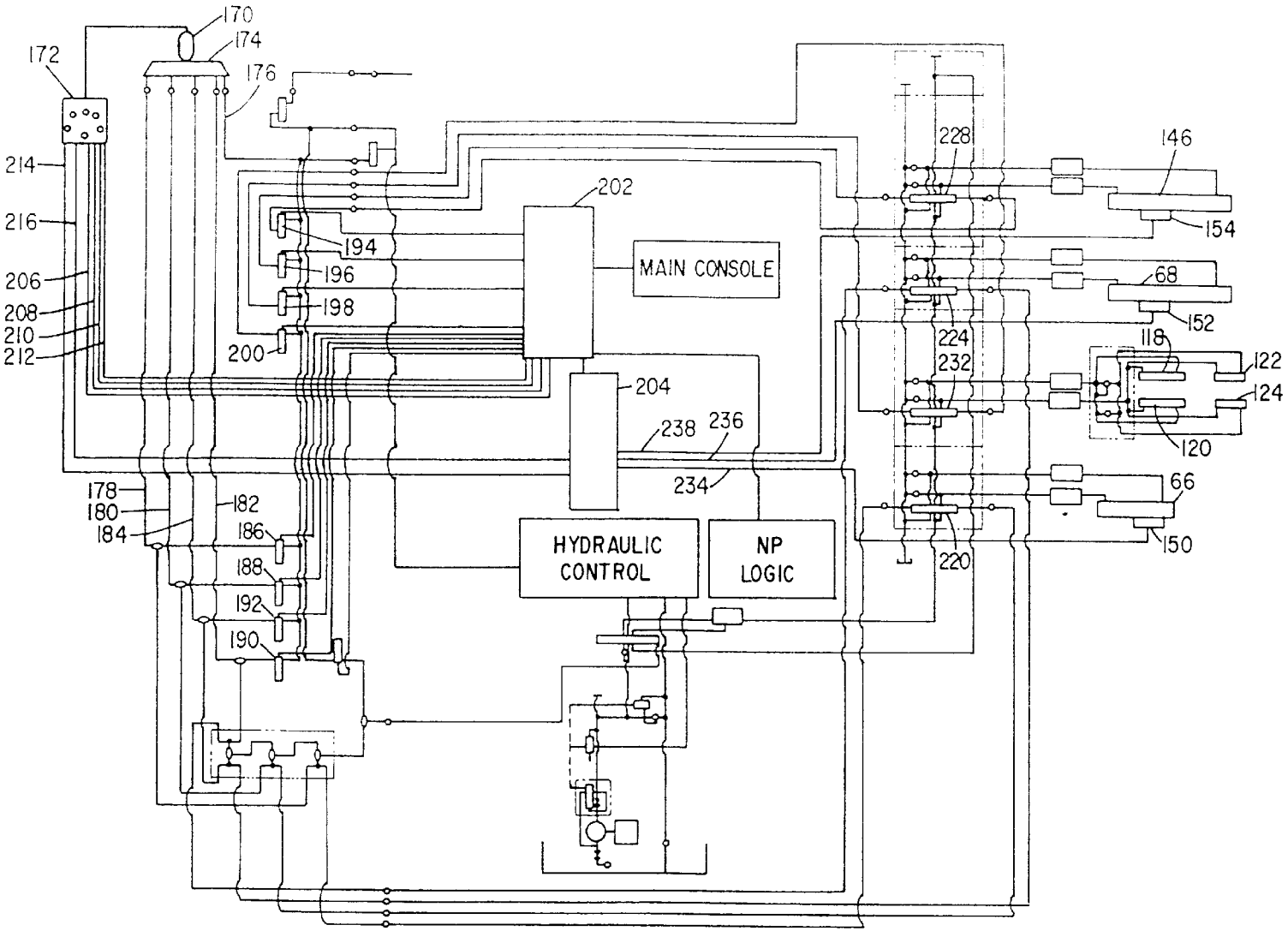
FIG. 9 is a schematic diagram of the electrical, pneumatic and hydraulic circuits used to control the lift, extension, swivel and grabbing of the container handling mechanism of the present invention.

FIGS. 7–9 depict a system for controlling the extension, lift and swivel of the means for carrying a container, and taken together show the electrical and fluid coupling of the microprocessor based controller and the hydraulic cylinders or actuators. FIGS. 7 and 8 show a joystick 170 and pad 172 used for controlling auto cycle and manual actuation of extension cylinder 66, lift cylinder 68, swivel cylinder 146, and grabber cylinders 118–124. A main pneumatic line 176 enters the joystick control console 174, wherein fore and aft movement (movement in the y-plane) or lateral movement (movement in the x-plane) of the joystick 170 controls the flow of fluid through the pneumatic lines 178–184 to corresponding pneumatic solenoids 186–192. Vector arrows indicate the direction that the joystick is moved to control the flow of fluid through one of pneumatic lines 178–184.

The pad 172 includes switches and associated electrical conductors 206–216 (see FIG. 8) that are electrically coupled to a corresponding programmable interface controller 202 (see FIG. 9) which is electrically coupled to pneumatic solenoids 194–200 and corresponding analog circuit 204 for automatic control of solenoids 186–190. Pneumatic solenoids 186–200 are electrically coupled to hydraulic solenoids 220–232 which control the actuation of double acting hydraulic cylinders 66, 68, 146, and 118–124 respectively. Potentiometers 150–154 are electrically coupled to analog circuit 204 as at 234–238 and send a signal representative of the actuation of the corresponding cylinders 66, 68, and 146 and relative position of the associated reach arm 24, lift arm 26, and swivel mount 14.

Figure 10:
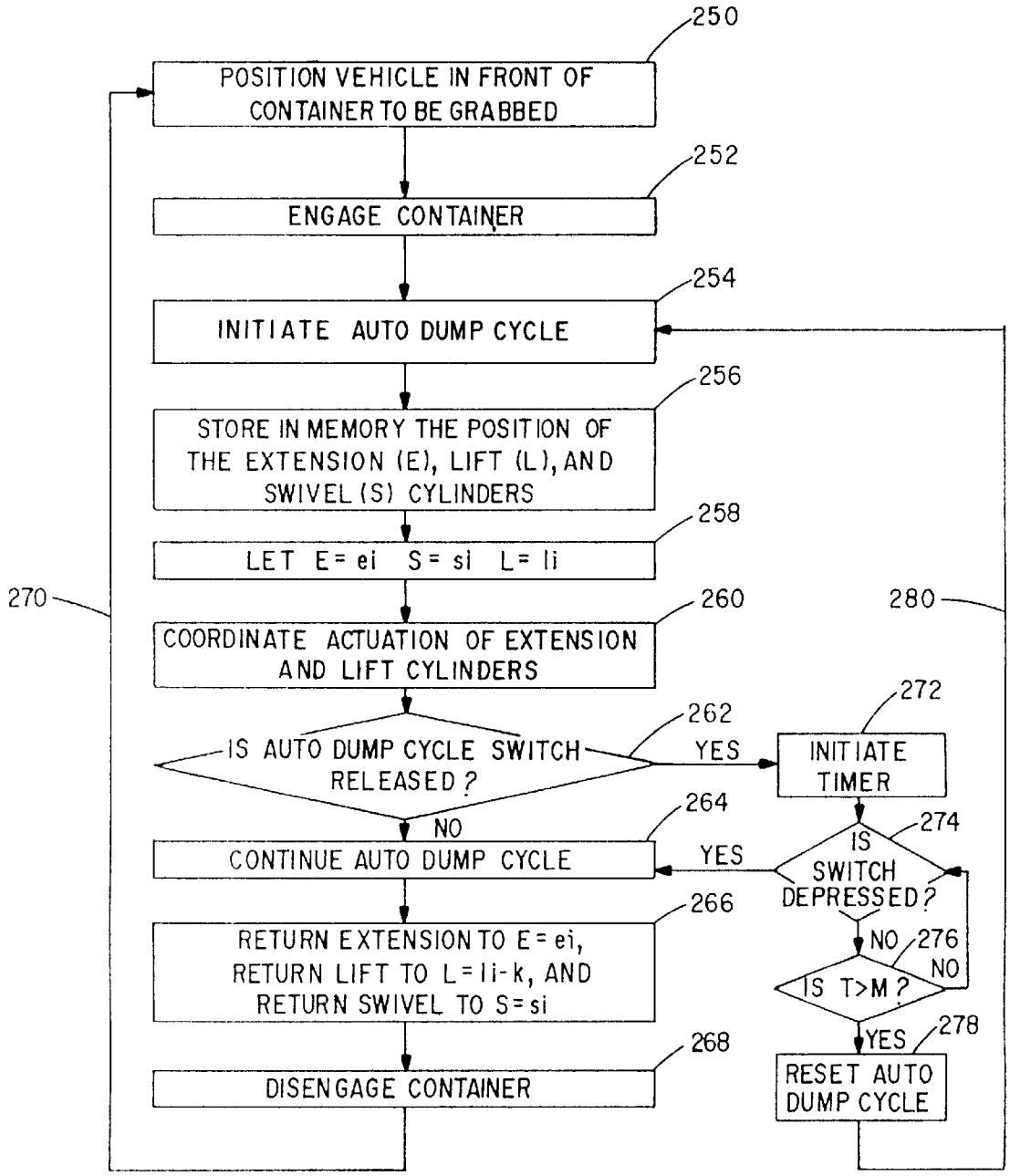
FIGS. 10 is a software flow diagram of the automatic dump cycle in accordance with the present invention.

Having described the essential constructional features of a representative embodiment of the present invention, the mode of operation will next be presented in conjunction with the flow chart of FIG. 10. At the beginning of a cycle, the operator positions the vehicle such that the container 30 is in range somewhere in front of the container handling mechanism 10 (see block 250). The operator then manipulates joystick 170 to manually control the coordinated actuation of reach 66 and lift 68 cylinders, to thereby align the grabber 28 with the container 30. The operator then closes switch 210 to actuate cylinders 118–124 and engage grabber 28 with container 30 (see block 252). The operator then depresses or closes switch 214 to activate the auto dump cycle (see block 254). The analog circuit stores in memory the output voltage signals received from potentiometers 150–154 which correlates with the position of the extension arm 24, lift arm 26, and swivel mount 14 and corresponding extension cylinder 66 (E), lift cylinder 68 (L), and swivel cylinder 146 (S) at the container pick-up position (see block 256). The initial output voltages are stored in memory as $e_i$, $l_i$, and $s_i$ (see block 258). The analog circuit 204 then controls and coordinates the actuation of extension cylinder 66 and lift cylinder 68, thereby raising and tipping the container above the charging hopper 20 (see block 260). Once the container 30 is in the dump position, the operator has the option of releasing the auto cycle switch 214 and using the joystick 170 to joggle the container 30 to jar loose any material remaining in the container 30. The operator then depresses the auto cycle switch 214 to continue the auto dump cycle (see block 264). The analog circuit and programmable interface 202 together control the actuation of cylinders 66, 68 and 146 such that the output voltages received from potentiometers 150–154 are equal to $e_i$, $l_{i-k}$, and $s_i$ (see block 266), wherein k is a preprogrammed constant determined to elevate the container slightly above the ground to avoid slamming the container on the ground during the auto cycle. In this manner the container is returned to the initial position on the curbside, but above the ground a predetermined distance. The operator then disengages the container 30 (see block 268) and then repeats the auto dump cycle for other containers (see loop 270).

During the auto dump cycle, if the auto dump cycle switch 214 is released a timer is initiated (see decision block 262 and block 272) tracking time (T). If the auto cycle switch 214 is again depressed before a preprogrammed maximum time (M) the auto dump cycle continues (see decision blocks 274 and 276, and block 264). If the tracked time T is greater than the preprogrammed maximum time M, the reset switch 216 must be closed (see block 278) and the auto cycle switch 214 depressed which re-initiates the auto dump cycle (see loop 280).

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A lift and dump mechanism to automatically lift, dump and return a container of interest to an original location comprising:

a) a frame;

b) carrying mechanism for carrying the container between pick-up, dump, and release locations;

c) swivel mount mechanism attached between said frame and said carrying mechanism for swiveling said carrying mechanism fore and aft relative to said frame, said swivel mount mechanism having a first position sensor coupled thereto for generating a signal representative of a rotational position of said swivel mount mechanism relative to the frame;

d) reach mechanism pivotally attached to said swivel mount mechanism for extending the carrying mechanism towards and away from the frame, said reach mechanism having a second position sensor coupled thereto for generating a signal representative of a position of said reach mechanism relative to the frame;

e) lift mechanism pivotally attached between said reach mechanism and said carrying mechanism for lifting the container between the pick-up, dump, and release locations, said lift mechanism having a third position sensor coupled thereto for generating a signal representative of a position of said lift mechanism relative to the reach mechanism;

f) a control system for controlling the position of said swivel system, said reach mechanism, said carrying mechanism and said lift mechanism, said control system being electrically coupled to said first, second and third position sensors, said swivel mount mechanism, said reach mechanism, said carrying mechanism, and said lift mechanism; and g) wherein said control system includes:

(1) a memory programmed to store values related to signals from said position sensors indicative of at least one coincident position of said swivel mount mechanism, said reach mechanism and said lift mechanism at said pick-up location;

(2) control device to reposition said swivel mount mechanism, said reach mechanism and said lift mechanism at said release location, said release location being at a height greater than that of said pick-up location.

2. The lift and dump mechanism of claim 1, wherein said frame is attached to a refuse collection vehicle of the side loading type.

3. The lift and dump mechanism of claim 1, wherein said control system includes a microprocessor-based controller electrically coupled to said first, second and third position sensors and said swivel mount mechanism, reach mechanism, carrying mechanism and said lift mechanism.

4. The lift and dump mechanism of claim 1, wherein said first position sensor includes a potentiometer mechanically coupled to a swivel mount mechanism.

5. The lift and dump mechanism of claim 1, wherein said second position sensor includes a potentiometer mechanically coupled to a reach arm mechanism.

6. The lift and dump mechanism of claim 1, wherein said third position sensor includes a potentiometer mechanically coupled to a lift mechanism.

7. The lift and dump mechanism of claim 1 wherein said release location differs from said pick-up location by a constant amount related to a height of said lift mechanism.

8. A lift and dump mechanism to automatically lift, dump and return a container of interest to an original location comprising:

a) a frame attached to a refuse vehicle of the side loading type;

b) carrying mechanism for carrying the container between pick-up, dump, and release locations;

c) swivel mount mechanism attached between said frame and said carrying mechanism for swiveling said carrying mechanism fore and aft relative to said frame, said swivel mount mechanism having a first position sensor coupled thereto for generating a signal representative of a rotational position of said swivel mount mechanism relative to the frame;

d) reach arm pivotally attached to said swivel mount mechanism for extending the carrying mechanism towards and away from the frame, said reach arm having a second position sensor coupled thereto for generating a signal representative of a position of said reach arm relative to the frame;

e) lift arm pivotally attached between said reach arm and said carrying mechanism for lifting the container between the pick-up, dump, and release locations, said lift arm having a third position sensor coupled thereto for generating a signal representative of a position of said lift arm relative to the reach arm;

f) a control system for controlling the position of said swivel system, said reach arm, said carrying mechanism and said lift arm, said control system being electrically coupled to said first, second and third position sensors, said swivel mount mechanism, said reach arm, said carrying mechanism, and said lift arm; and g) wherein said control system includes:

(1) a memory programmed to store values related to signals from said position sensors indicative of at least one coincident position of said swivel mount mechanism, said reach arm and said lift arm at said pick-up location;

(2) control device to reposition said swivel mount mechanism, said reach arm and said lift arm at said release location, said release location being at a height greater than that of said pick-up location.

9. The lift and dump nechanism as in claim 8, wherein said reach arm and said lift arm can be extended together in a combined power stroke.

10. The lift and dump mechanism of claim 8, wherein said control means includes a microprocessor-based controller electrically coupled to said first, second and third position sensors.

11. The lift and dump mechanism of claim 8, wherein said first position sensor includes a potentiometer coupled to the swivel mount.

12. The lift and dump mechanism of claim 8, wherein said second position sensor includes a potentiometer coupled to the reach arm.

13. The lift and dump mechanism of claim 8, wherein said third position sensor includes a potentiometer coupled to the lift arm.

14. The lift and dump mechanism of claim 8 wherein said release location differs from said pick-up location by a constant amount related to the height of said lift mechanism.

15. The method of automatically engaging lifting, dumping and returning a container of interest comprising the steps of:

(a) providing a lift and dump mechanism having sensors and memory adapted to provide and store data indicative of the position of a container being handled by the lift and dump mechanism and a control system adapted to use stored data to return said lift and dump mechanism to a predetermined position;

(b) operating said lift and dump mechanism to approach and engage a container of interest to be dumped;

(c) sensing and storing data indicative of the position of the lift and dump mechanism at the time of engagement of said container of interest;

(d) storing said positional information in memory;

(e) lifting and dumping said container; and (f) returning said container to a predetermined position related to the position indicated by the stored positional information wherein said container is returned and released at a position just above that from which it was originally retrieved so that it is not forced into its original support.

* * * * *